United States Patent [19]

Blaine

[11] Patent Number: 4,485,539

[45] Date of Patent: Dec. 4, 1984

[54] METHOD AND JIG FOR FURNITURE CONSTRUCTION

[75] Inventor: Anthony F. Blaine, Stamford, England

[73] Assignee: Prutec Limited, England

[21] Appl. No.: 328,076

[22] Filed: Dec. 7, 1981

[30] Foreign Application Priority Data

| | | | |
|---|---|---|---|
| Dec. 8, 1980 | [GB] | United Kingdom | 8039231 |
| Dec. 9, 1980 | [GB] | United Kingdom | 8039372 |
| Dec. 19, 1980 | [GB] | United Kingdom | 8040699 |
| Mar. 16, 1981 | [GB] | United Kingdom | 8108161 |
| May 18, 1981 | [GB] | United Kingdom | 8115097 |
| May 26, 1981 | [GB] | United Kingdom | 8116017 |

[51] Int. Cl.[3] ..... B25H 1/04; B25H 1/10; B25H 7/02

[52] U.S. Cl. ..... 29/91.1; 29/467; 29/281.1; 29/281.5

[58] Field of Search ..... 29/467, 91, 91.1, 281.1, 29/281.5

[56] References Cited

U.S. PATENT DOCUMENTS 4,146,954 4/1976 Day ..... 29/467

*Primary Examiner*—Howard N. Goldberg
*Assistant Examiner*—Timothy V. Eley
*Attorney, Agent, or Firm*—Ostrolenk, Faber, Gerb & Soffen

[57] ABSTRACT

The invention relates to a method and a jig for constructing a carcase-type article of furniture. A panel which is to form a part (e.g. a door) of the finished article, is placed down on a horizontal surface. A jig is assembled around the panel using the panel as a template, the jig incorporating abutment blocks to contact the edges of the panel and locating blocks in predetermined positions relative to the abutment blocks to define the positions of the carcase walls and to locate the walls in position while being secured to one another. The carcase walls are cut to the desired size, and placed edge down within the locating blocks of the jig. Securing the walls to one another now forms a carcase the walls of which are correctly aligned with the edges of the panel.

4 Claims, 41 Drawing Figures

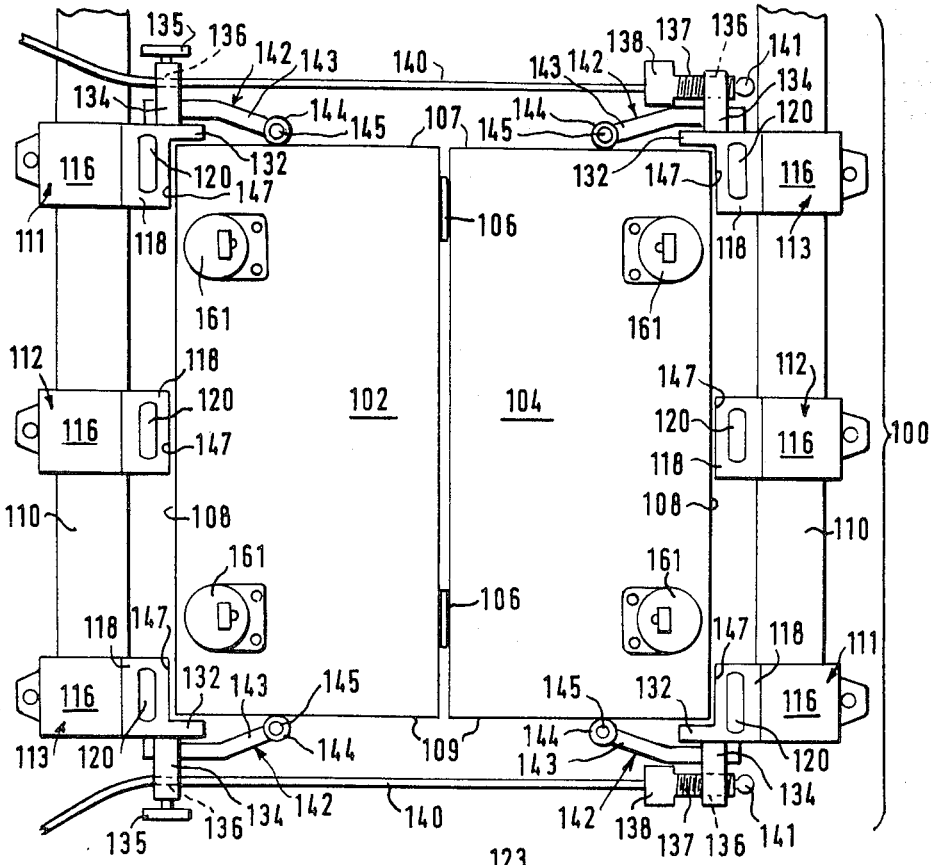
FIG. 1.
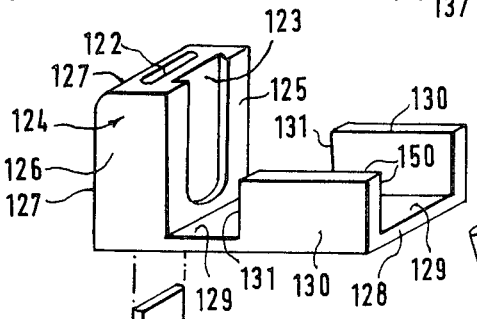
FIG. 2.
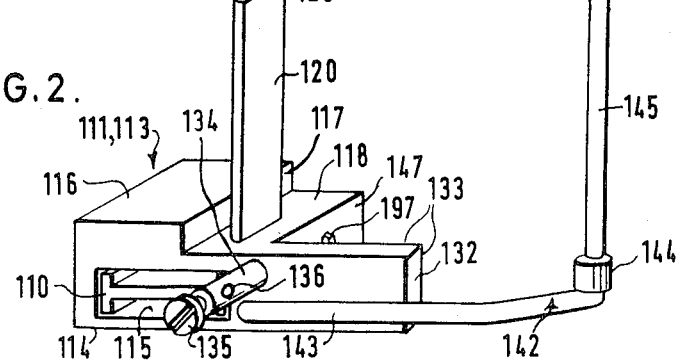

METHOD AND JIG FOR FURNITURE CONSTRUCTION

This invention relates to jig apparatus and in particular to jig apparatus for use in the assembly or manufacture of a carcase-type article of furniture. As used herein, the term "carcase-type article of furniture" includes articles of furniture comprising a carcase of parallelepiped form defined by four main carcase-pieces (usually of board) at right angles to one another. Examples of such carcase-type articles of furniture are a bookcase having a main carcase and one or more shelves, and a cupboard (with or without shelves) having a main carcase and one or more doors mounted thereon.

Considerable difficulty may be experienced even by an expert cabinet maker, and certainly by a home handyman, in the making and assembly of carcase-type articles of furniture. Such difficulties arise because the lengths of board used for the carcase sides, top and bottom (and for any shelves) must all be of the correct dimensions and must all be held at the correct relative relationships such that any two lengths are mutually parallel or mutually perpendicular as required. Where doors or other frontpieces are to be hung on the carcase, further difficulties have in the past arisen from the need to shape the doors accurately to the correct size, either for close fitting within the carcase opening or for overlapping the carcase front edge by a predetermined amount all round. Such difficulties are considerably aggravated where a pair of double doors, i.e. both left-hand and right-hand doors, are oppositely mounted on the one carcase such that the door edges opposite the respective hinge-mounted edges meet with a predetermined gap between them, and are still further aggravated where the one carcase has more than a single pair of doors (e.g. to provide a small upper cupboard above a large wardrobe-type cupboard).

The object of the present invention is to provide a jig and a method of construction which mitigates at least some of the foregoing difficulties.

According to one aspect of the invention there is provided a method of constructing a carcase-type article of furniture, which comprises planing down horizontally a panel which is to form a part of the finished article, assembling a jig around the panel using the panel as a template, the jig incorporating abutment surfaces to contact the edge of the panel and locating means in predetermined portions relative to the abutment to define the positions of the carcase walls and to locate the walls in position while being secured to one another, cutting the carcase walls to the desired size, placing the carcase walls edge down within the locating means defined by the jig, and securing the walls to one another whereby to form a carcase the walls of which are correctly aligned with the edges of the panel.

According to a second aspect of the invention there is provided a jig for use in the construction of a carcase-type article of furniture, the jig comprising a plurality of abutment means for abutting respective edges of a panel which is to form a part of the finished article, mounting means for maintaining the abutment means in abutting relation with the edges of the panel and locating means associated with the respective abutment means and arranged in a predetermined position relative thereto for defining the position of the carcase walls relative to the edges of the panel and locating the said walls while being secured to one another.

It will be noted that by effectively building the carcase around the door or the back, as the case may be, the correct dimensions are obtained with ease and as the door mounting can be done with the jig still in place, correct alignment can be obtained automatically even when several doors are involved.

By way of non-limiting example, embodiments of this invention will now be described with reference to the accompanying drawings which are not all to the same scale.

FIG. 1 is a diagrammatic plan view of parts of jig apparatus according to the invention, in a first embodiment, and at an initial stage of use;

FIG. 2 is an exploded perspective view of an abutment block and a locating block of which only the abutment block is shown in FIG. 1;

Figure 4:
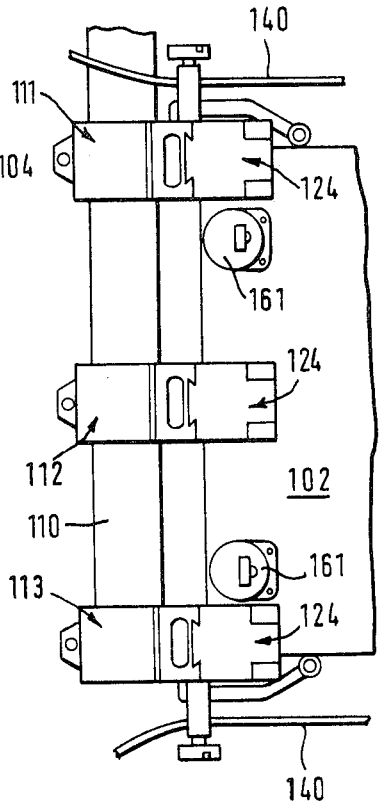
Figure 4A:
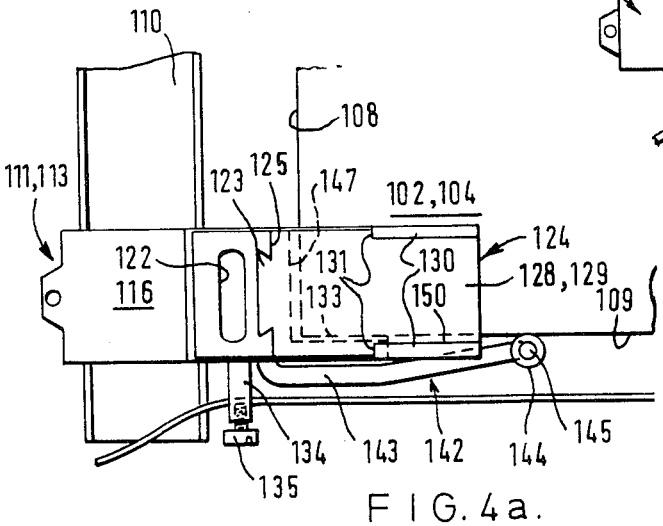
Figure 5:
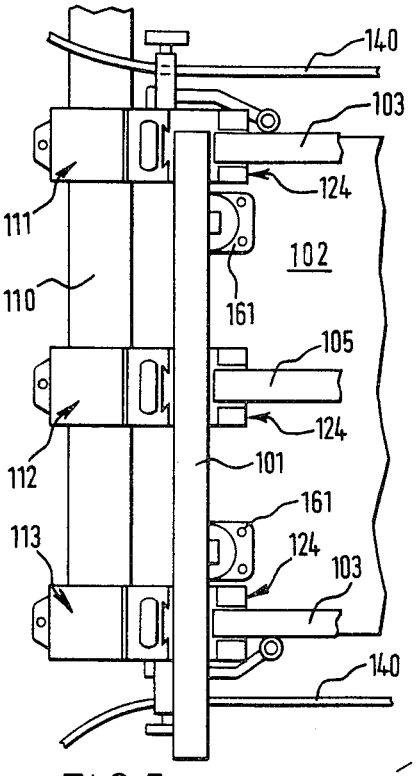

FIGS. 4 4*a* and 5 are schematic plan views of parts of said first embodiment at second and third stages of use;

FIG. 4*a* being an enlarged view of part of FIG. 4.

Figure 7:
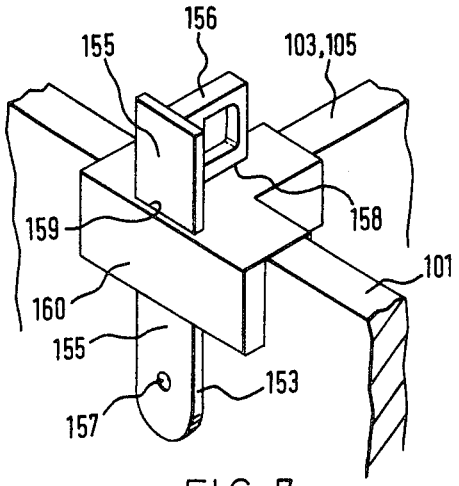
Figure 6:
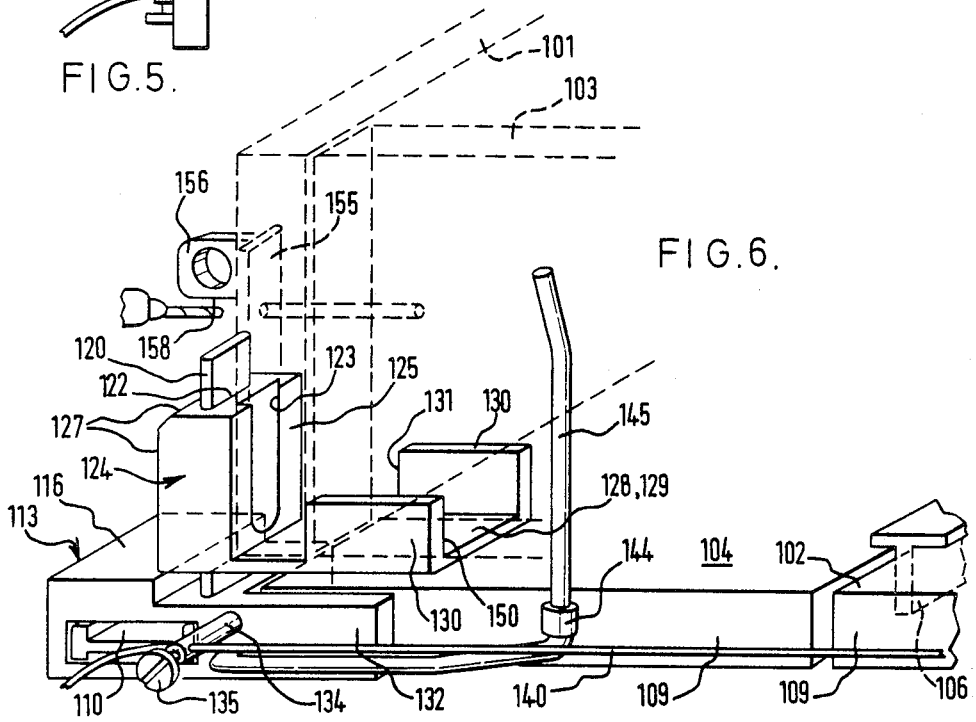
Figure 8:
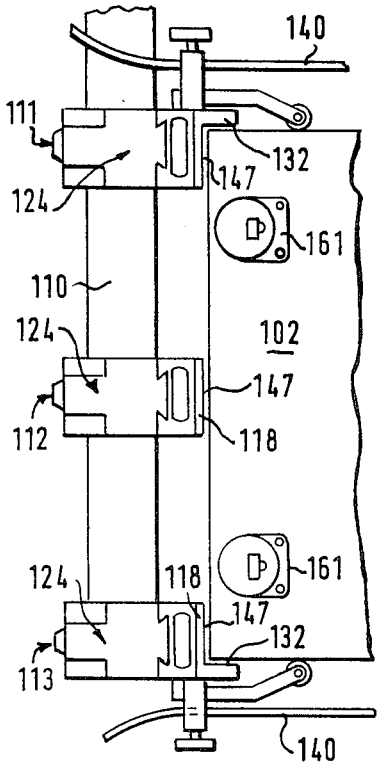
Figure 9:
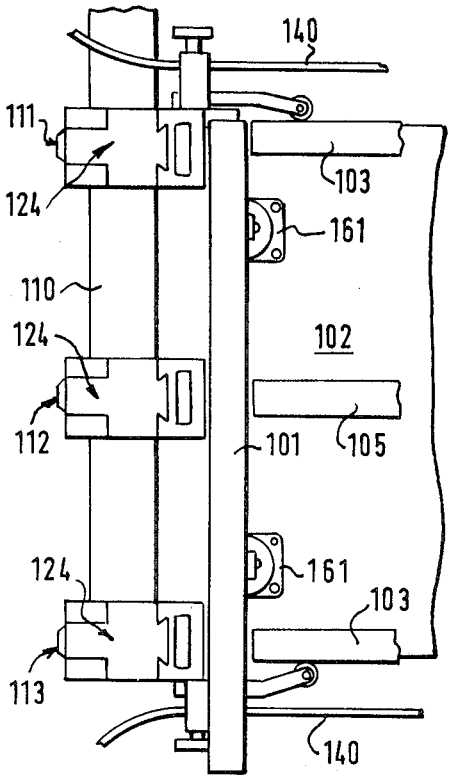
Figure 10:
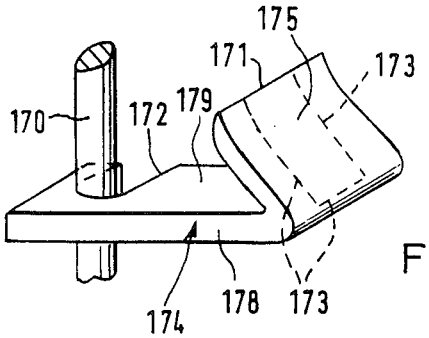
Figure 11:
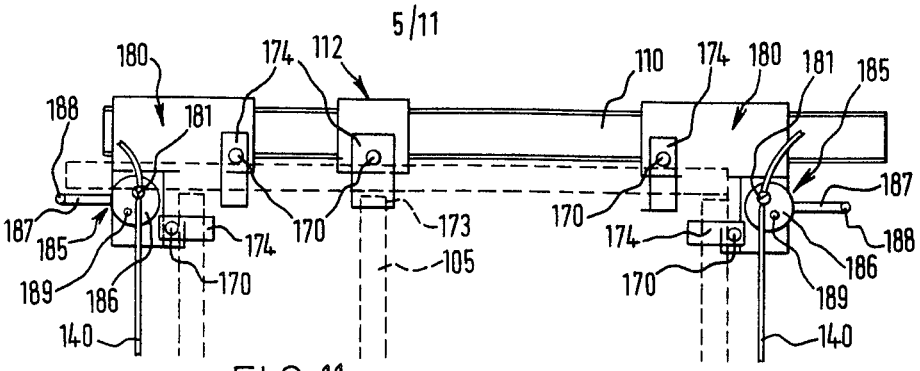
Figure 12:
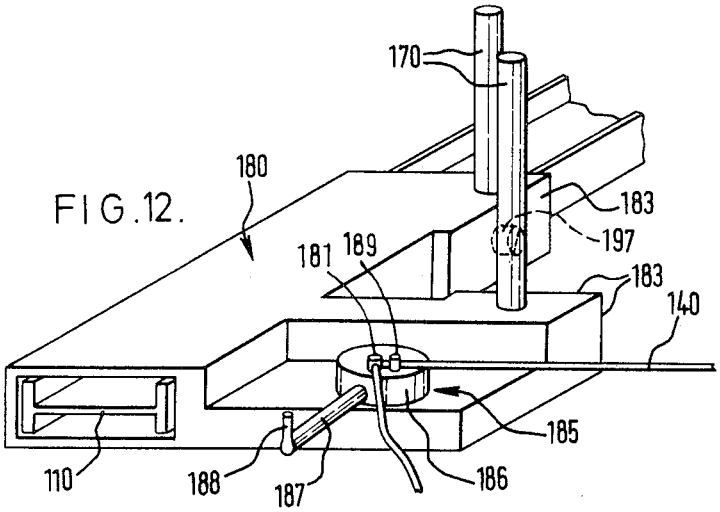
Figure 13:
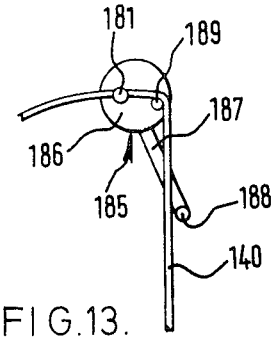
Figure 14A:
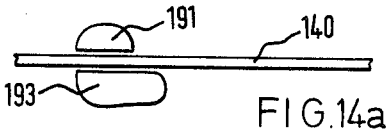
Figure 14B:
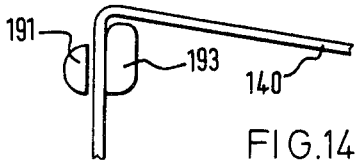
Figure 14C:
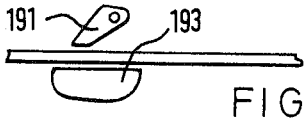
Figure 15A:
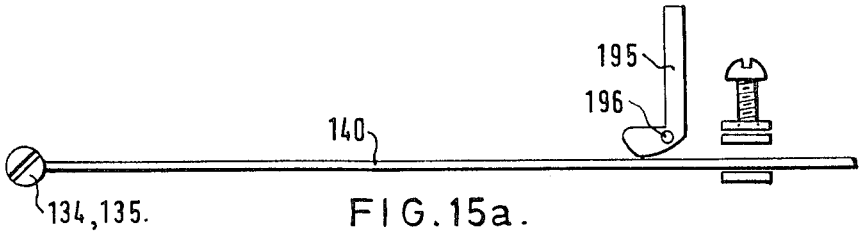
Figure 15B:
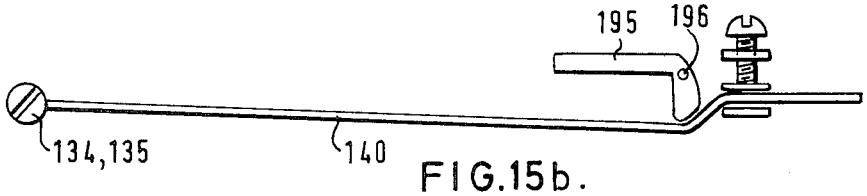
Figure 16:
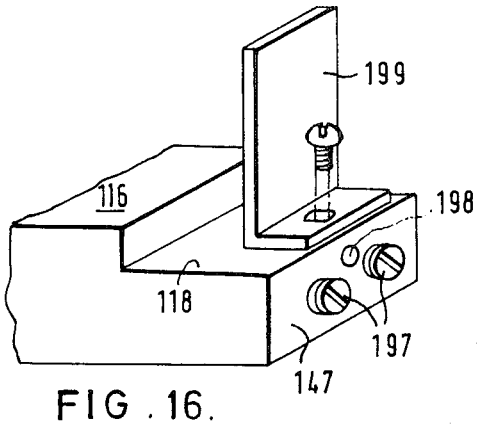
Figure 17:
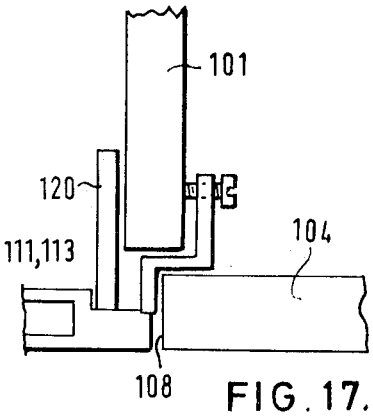
Figure 18:
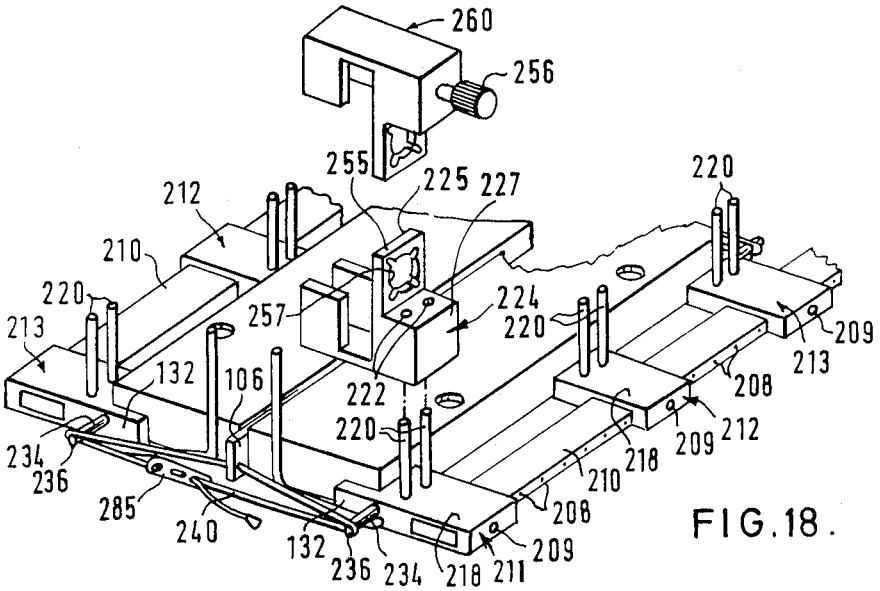
Figure 19:
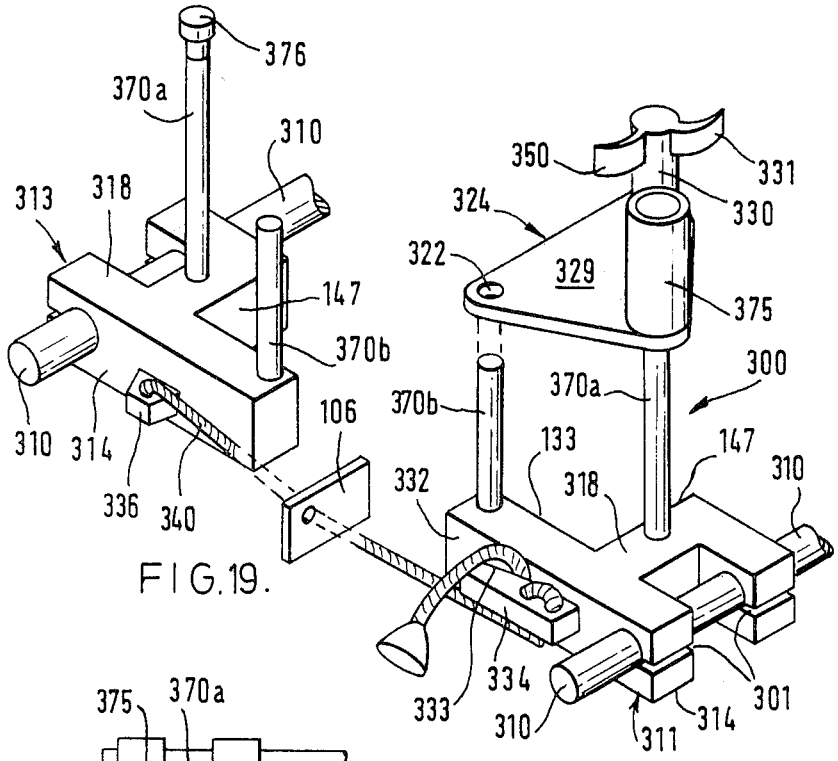
Figure 20A:
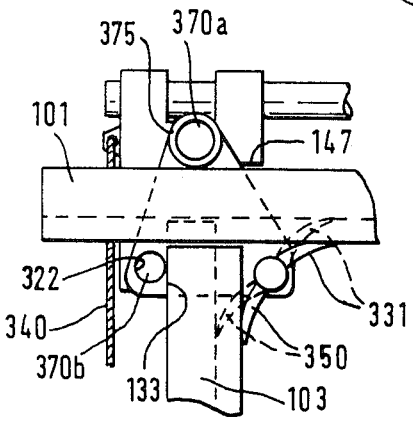
Figure 20B:
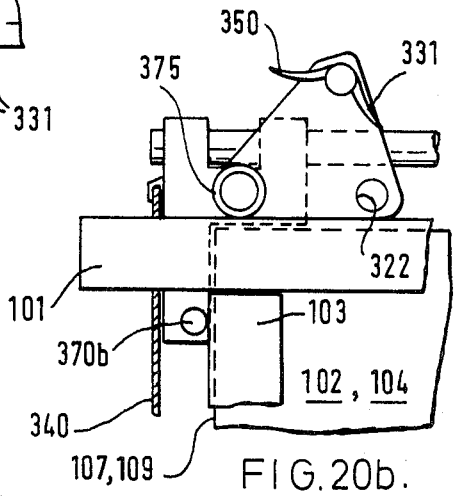
Figure 21:
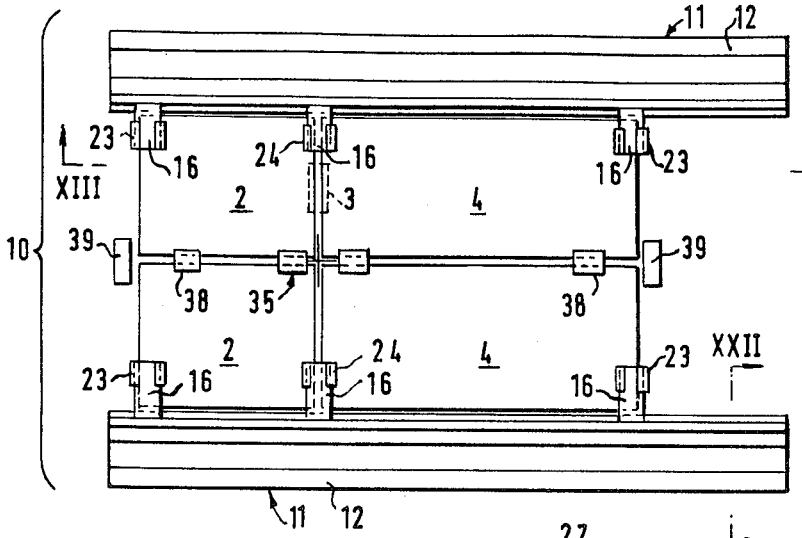
Figure 22:
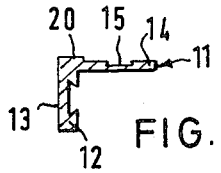

FIGS. 6 and 7 are perspective views of parts of said first embodiment at fourth and fifth stages of use;

FIGS. 8 and 9 are schematic plan views of parts of said first embodiment at sixth and seventh stages of use;

FIG. 10 is a schematic perspective view of part of a second embodiment of this invention;

FIG. 11 is a schematic plan view of parts of said second embodiment in use;

FIG. 12 is a perspective view of a modified part shown in FIG. 11;

FIG. 13 shows schematically a detail of FIG. 12 in an alternative position;

FIGS. 14*a*, 14*b* and 14*c* are diagrammatic views of a variation of parts of said second embodiment in first and second positions;

FIGS. 15A and 15B are diagrammatic views of a variation of parts of said first embodiment;

FIG. 16 is a perspective view of part of the first embodiment but incorporating further modifications;

FIG. 17 is a side plan view of a carcase holding arrangement;

FIG. 18 is an exploded perspective view of parts of a third embodiment of this invention;

FIG. 19 is a similar view of parts of a fourth embodiment of this invention;

FIGS. 20*a* and 20*b* are plan views of parts shown in FIG. 19 in different stages of use;

FIG. 21 is a schematic plan view of jig apparatus 10 according to a fifth embodiment of this invention, the jig apparatus being shown associated with two double-doors 2, 4 that are to form the front pieces of a carcase-type article of furniture such as a cupboard;

FIG. 22 is a cross-sectional view along the line XXII—XXII of FIG. 21.

Figure 24A:
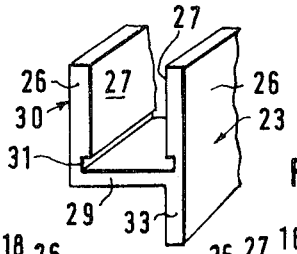
Figure 23:
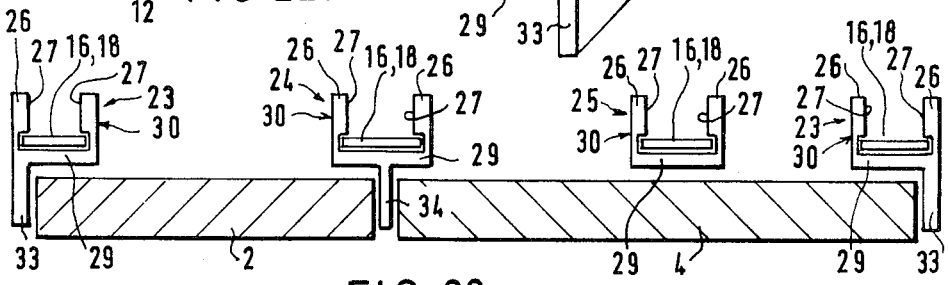
Figure 24:
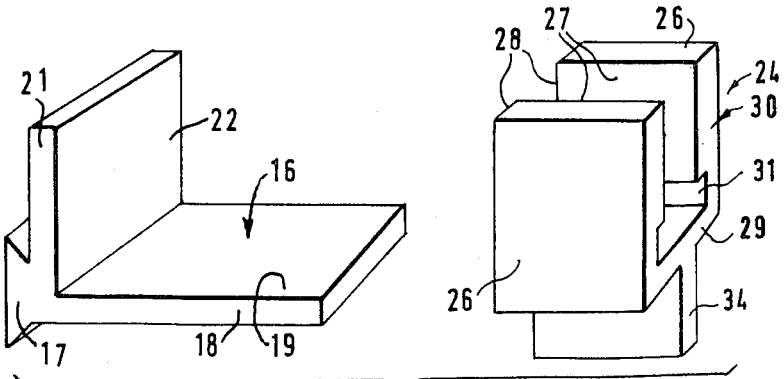
Figure 25:
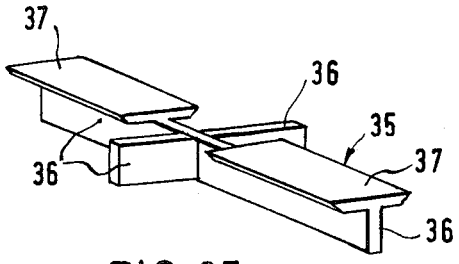
Figure 26:
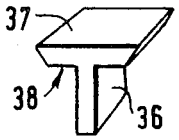
Figure 27:
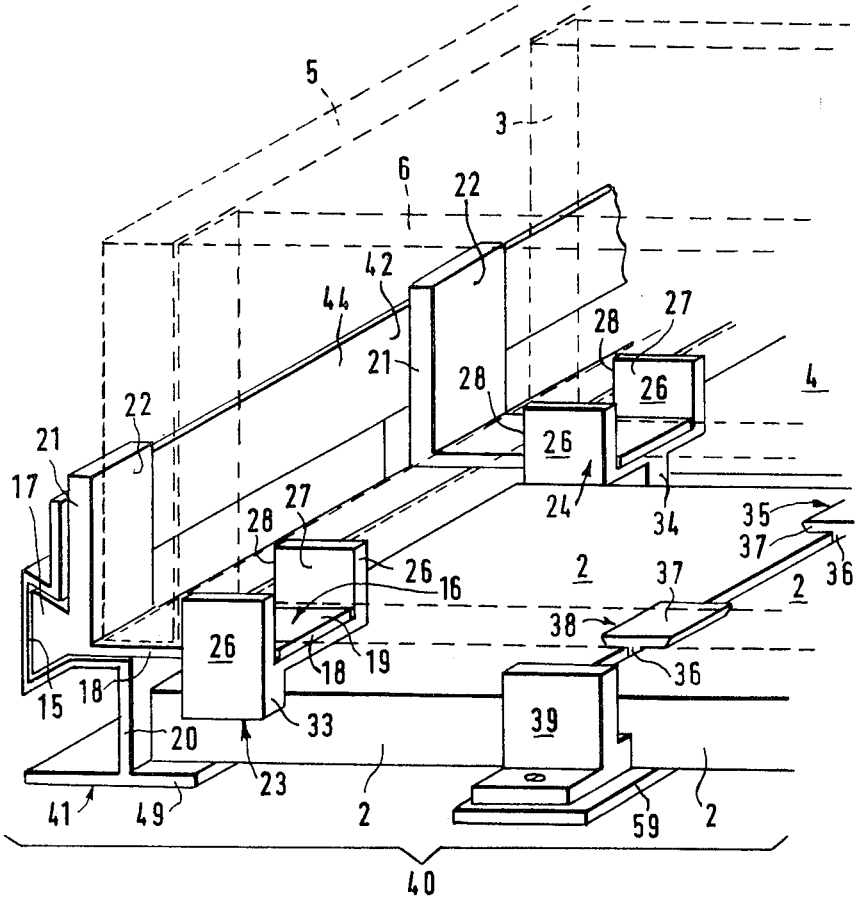
Figure 28A:
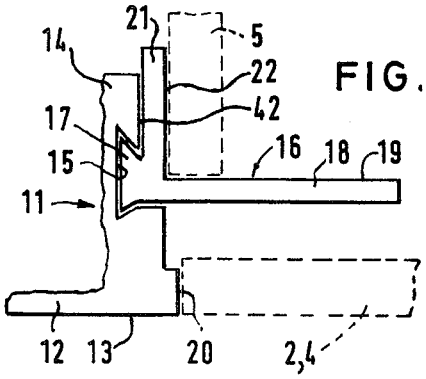
Figure 28B:
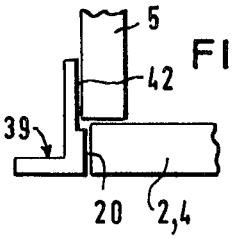
Figure 28C:
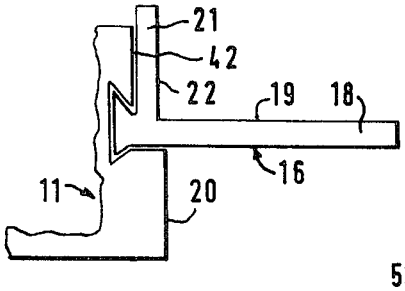

FIG. 23 is a schematic representational cross-section along the line XXIII—XXIII of FIG. 1, a guide member 11 of the jig apparatus 10 being omitted;

FIG. 24 is a schematic perspective view of two parts of the jig apparatus 10;

FIG. 24*a* is a schematic perspective view of an alternative one of the parts shown in FIG. 24;

FIG. 25 id a schematic perspective view of another part of the jig apparatus 10;

FIG. 26 is a perspective schematic view of still another part of the jig apparatus 10;

FIG. 27 is a schematic perspective view of jig apparatus 40 embodying this invention;

FIG. 28*a* is an end elevation of part of the jig apparatus 10,40;

FIG. 28*b* is an end elevation of another part of the jig apparatus 10,40;

FIG. 28*c* is an end elevation showing a modified form of the part shown in FIG. 28*a;*

Figure 28D:
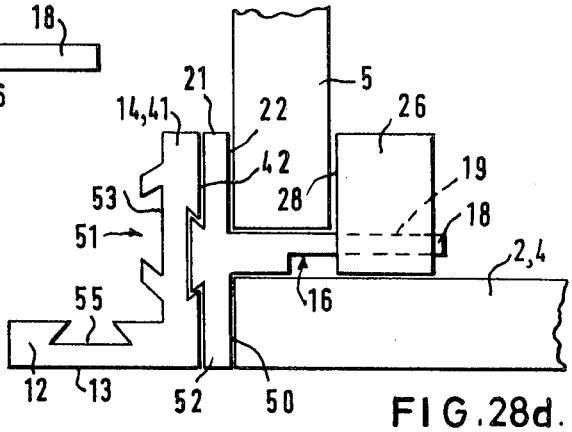

FIG. 28*d* is an end elevation of another modification to the parts shown in FIG. 28*a;*

Figure 29:
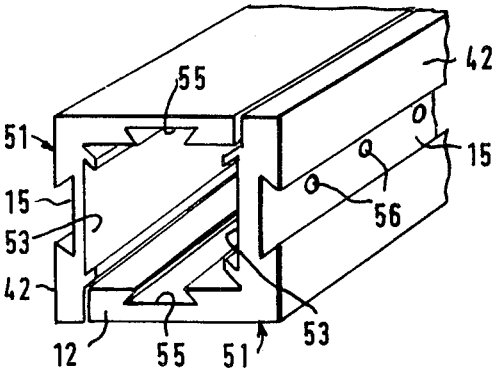

FIG. 29 is a schematic perspective view of paets similar to those shown in FIG. 28*d;*

Figure 30:
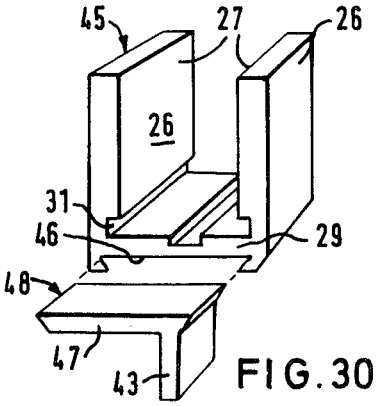

FIG. 30 is a schematic exploded perspective view of parts forming modifications of the items shown in FIGS. 24 and 24*a;*

Figure 31:
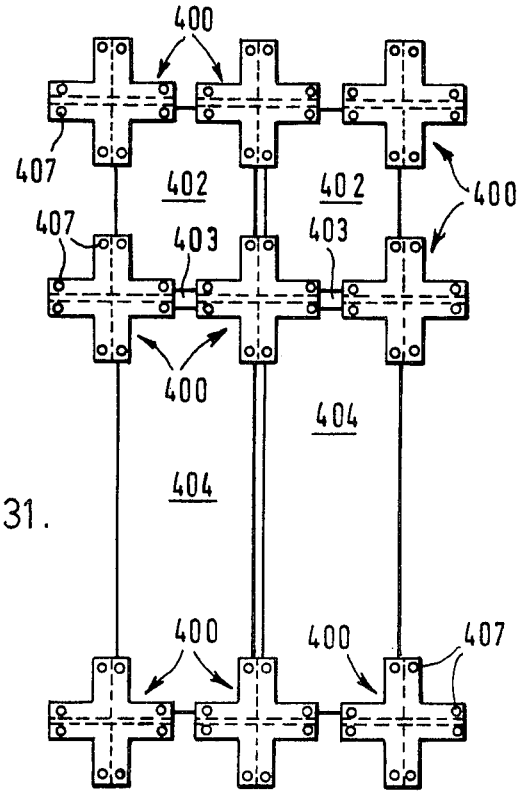
Figure 32:
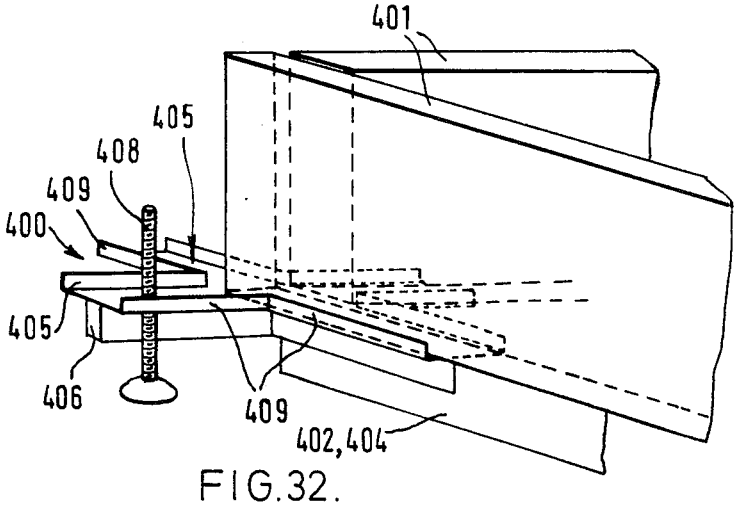

FIG. 31 is a plan view of parts of a sixth embodiment of this invention in an initial stage of use; and FIG. 32 is a perspective view of a portion of the apparatus of FIG. 31 in a later stage of use.

The fundamental method employed for the construction of carcase-type articles of furniture described in the following embodiments is to build the carcase generally horizontally so that during construction the carcase pieces (top, bottom and sides) and any shelves are vertically upstanding on their front or rear face edges and with the doors or the back, as the case may be lowermost and in a horizontal plane, and after construction the assembled carcase, with any shelves and/or doors, can be raised into the normal vertical condition. The main feature of the invention is that the door(s) or back are used as a template in assembling a jig which enables the required carcase dimensions to be measured with ease and serves to hold the parts of the carcase together while they are being secured to one another. Where the finished article has doors and a back, the doors are used as a template, but when the article has no doors, as in the case of bookshelves, then the back may be used as a template.

The schematic plan view of FIG. 1 illustrates the arrangement of parts of one preferred form of jig apparatus 100 embodying this invention for the construction of a cupboard having a pair of double doors 102, 104 and a single shelf 105 (not shown in FIG. 1) extending across the cupboard. The jig apparatus 100 comprises two rails 110 of H-section or overturned I-section each extending through three abutment blocks 111,112 and 113 and co-operating slidably therewith in a close fitting relationship.

As best shown in FIG. 2, each of the corner abutment blocks 111 and 113 has a bottom surface 114, a rectangularsectionthrough channel 115 through which the rail 110 extends, and a stepped upper surface formed by upper and lower faces 116, 118 separated by a rise 117 normal to faces 116, 118. The faces 114, 116 and 118 of the respective abutment blocks are all parallel to one another and at the same level for all the six abutment blocks 111–113. Each horizontal surface 118 has a guide 120 extending vertically upwardly therefrom, the guide 120 being slidably engageable in a slot 122 provided through a locating block 124. Each of the six such locating blocks 124 (omitted from FIG. 1 for clearer illustration of the initial stage of use) is of generally J-shaped side elevation having a main upstanding limb 126, a horizontal limb 128 and two parallel, shorter limbs 130 upstanding from the free end of limb 128, at the sides thereof. Limb 126 has a primary vertical surface 125 facing the adjacent edges 131 of limbs 130 and also has a secondary or supplementary vertical surface 127 parallel to surface 125 and facing in the opposite direction. The vertical slot 122 in main limb 126 is equi-distant from each of that limb's surfaces 125, 127. A vertically extending shallow groove 123 of dovetail cross-section is set into the surface 125 of limb 126. The groove 123 being closed at its lower end adjacent the upper horizontal surface 129 of limb 128 and being open at its upper end coincident with the top of limb 126.

Each of the abutment blocks 112 has its surface 118 of rectangular plan outline, whereas each of the abutment blocks 111,113 has its surface 118 of L-shaped plan outline, whereas each of the abutment blocks 111,113 has its surface 118 of L-shaped plan outline, the 'horizontal' limbs of the 'L' being referenced 132. A cylindrical spigot 134 extends outwardly from adjacent the root of each limb 132, a cross-hole 136 being provided adjacent the free end of each spigot 134. In respect of two of the abutment blocks 111,113 the spigot 134 is provided with a screw-threaded bore extending from the free end of the spigot at least as far as the cross-hole 136, a screw 135 being threadedly received in said bore. In respect of the other two corner abutment blocks 111 and 113, the cross-hole 136 is screw-threaded and threadedly receives therein a hollow bolt 137 having a knurled head 138. A cable 140 having an enlarged end 141 (e.g. provided by a welded-on nipple) in use extends through the hollow bolt 137 adjacent one rail 110 and through the cross-hole 136 in the spigot 134 adjacent the other rail 110, the enlarged cable end 141 being adjacent and engageable by the end of the hollow bolt 137 such as to prevent the cable 140 being pulled right through the bolt 137 towards said other rail 110 (see FIG. 1).

Each corner abutment block 111,113 also has a generally L-shaped member 142 extending substantially in a vertical plane (see FIG. 2). One arm 143 of each member 142 extends substantially horizontally from adjacent the root of limb 132 and below spigot 134. The other arm 145 of each member 142 extends upwardly from the free end of arm 143, a collar 144 of plastics material being provided on arm 145 adjacent the angle between the two arms 143, 145. As apparent from FIG. 1, each L-shaped member 142 is arranged such that a portion of its arm 145 lies in the same vertical plane as the inner surface of its associated limb 132.

Facing towards the doors 102, 104 (FIG. 1) each abutment block 111–113 has an abutment face 147 extending between the surfaces 114 and 118, this surface 147 on each of unitary items 111 and 113 being at right angles to the surface 133. With the locating blocks 124 located on their respective supporting abutment blocks 111–113 in the manner indicated in FIG. 2, the vertical plane containing surface 147 lies parallel to and in between the two vertical planes containing surfaces 125 and 131 respectively and is spaced by a predetermined distance, e.g. 1.5 mm, from the vertical plane containing surface 125. Also, the vertical plane containing the inner surface 150 of outermost limb 130 is spaced outwardly by a like predetermined distance from the vertical plane containing abutment surface 133. Optionally the side corner edges of vertical surfaces 147 on the abutment blocks 112 may be chamfered.

Figure 3:
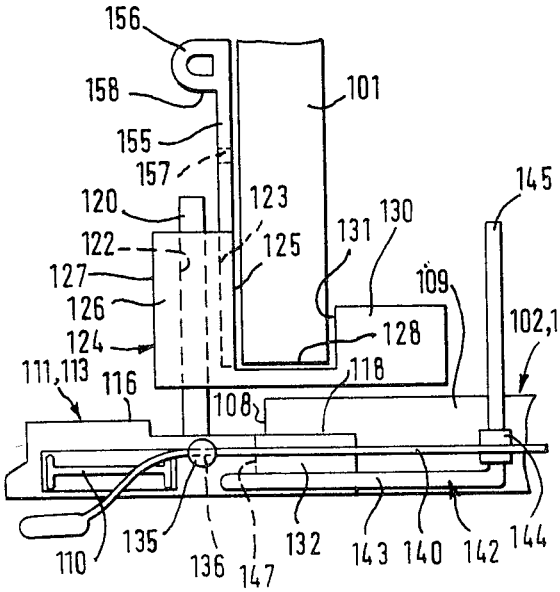
FIG. 3 is a schematic side elevation of the two blocks of FIG. 2 at a later fourth stage of use.

The illustrated jig apparatus 100 may be used to construct a variety of carcase-type articles of furniture. One example, now to be described, is a plinth-mounted, double-doored cupboard having a single shelf across it. Initially the two doors 102, 104 are placed front face down on a horizontal surface with one or more spacers 106 of predetermined thickness, e.g. 3 mm, between them. A rail 110 carrying three abutment blocks 111–113 is placed on the horizontal surface alongside the hinge-side edge 108 of each door, the lower surface 114 of each abutment block being at the same horizontal level as the front face of the doors (see FIG. 3). The rails 110 are pushed towards one another to sandwich the doors 102, 104 between them until the edges 108 of the doors abut the surfaces 147 on all three blocks. The two opposite abutment blocks 112 are moved longitudinally by the rails 110 to the position desired for the cross-shelf 105 (FIG. 5) and locked therein by a rail-engaging grub-screw (not shown) threaded in each block 112. The corner abutment blocks 111 and 113 on each rail 110 are moved longitudinally of that rail until their surfaces 133 abut the top and bottom edges 107, 109 of the doors 102 and 104, are locked therein by rail-engaging grub-screws (not shown) threadedly mounted in each corner abutment block 111,113. The two above described clamping mechanisms comprising parts 134–138 and cable 140 are then operated to tension the cables and thereby clamp the jig apparatus parts illustrated in FIG. 1 to the doors 102, 104 by rotating the knurled head 148 clockwise to move the cable's enlarged end 141 away from the adjacent spigot 136. The siz locating blocks 124 are then mounted one on each abutment blocks 111 to 113 by sliding cooperation between the latter's guide 120 and the former's slot 122. The attitude adopted by each locating block is such that its limbs 128 and 130 overlie a door (FIGS. 3 and 4).

Hereinafter the expressions "forward directed" and "directed forwardly" in relation to a locating block 124 will signify its adopting an attitude such as that shown in FIGS. 3 and 4. By contrast, when a locating block 124 adopts an attitude such as that shown in FIG. 8 and FIG. 9 in which its limbs 128 and 130 overlie surface 116 and do not overlie a door, the expressions "reverse directed" or "directed rearwardly" will be used in relation thereto.

With the jig apparatus 100 assembled as shown in FIG. 4 which shows only one side of the intended final carcase-type article of furniture) the next stage of construction is reached by the following steps. The carcase side pieces 101 are cut to the desired length and placed front edge downwards between surfaces 125 and 131 of each locating block 124 such as to be held vertically between them and be supported by its front edge on the horizontal surface 129 of that locating blocks limb 128 and above the level of the doors. Means (not shown) may optionally be provided in association with limbs 130 to urge each side carcase piece 101 towards surfaces 125, examples of such means being resilient members (e.g. leaf springs on the edge surfaces 131), or wedges, or bolts or other screw-threaded elements extending threadedly through "ears" projecting laterally outwards of the limbs 130. Top and bottom carcase pieces 103 and the shelf 105 are then cut to correspond to the distance between the inner faces of carcase side pieces 101. Each of the carcase pieces 103, 105 is then inserted front edge downwards in between limbs 130 of a locating block 124 such as to be held vertically between these limbs 130 and be supported by that unitary items limb 128 above the level of the doors (see FIGS. 5 and 6). Means (not shown) may optionally be provided in association with limbs 130 to urge the top and bottom carcase pieces 103 towards surfaces 150, i.e. outwardly of the jig apparatus 100, examples of such means being appropriately located resilient members, wedges or screw-threaded elements.

It will be apparent from FIG. 4*a*, that due to the above-mentioned predetermined distances between surfaces 125 and 147, and between surfaces 133 and 150, the carca pieces 101 and 103 respectively will overlap the edges of the doors 102, 104 by said predetermined distances. This will lead automatically to correct alignment of the doors with the carcase on all sides. FIG. 4*a* also illustrates the markings of a distance scale upon the upper surface of rail 110.

The carcase pieces 101, 103 and shelf 105 which, as shown in FIG. 6, are held in position by the jig apparatus 100, are then secured together in the following manner. An apertured flat member 155 provided with chamfered edges 153 is a sliding fit within dovetail-section groove 123. When so inserted into main limb 126 of a locating block 124, the member's aperture 157 is disposed a predetermined distance from the front edge of the carcase piece and provides a drill-bit guide. The shelf 105 and the top and bottom carcase pieces 103 are corrected for square, i.e. correct perpendicularity to the side carcase pieces 101, prior to drilling. Initially a pilot hole is drilled, via aperture 157, through carcase piece 101 and into carcase piece 101 and into carcase piece 103 or shelf 105. A full bore is then drilled through carcase piece 101 and countersunk (although a slightly different use of the flat member 155 could provide in the alternative for discrete plugs to be inserted between carcase pieces), and the carcase pieces 101, 103 and shelf 105 interconnected adjacent their front edges by screws screwed into the bores.

FIG. 7 indicates how the same flat member 155 may then be used in conjunction with a unit 160 to provide the screw holes for use in securing together the carcase pieces 101, 103 and shelf 105 adjacent their edges which are horizontally uppermost during assembly. The unit 160 comprises a generally T-shaped plate with a wall depending from each side edge of the plate, a slot 159 being provided through the plate's upper surface in line with the "upright" of the "T" and in the inner surface of the depending wall forming the "crossbar" of the "T". This unit 160 is push-fit mounted (or otherwise fixed e.g. by threaded bolts) onto the adjoining rear edges of two carcase pieces 101, 103 (or of a carcase piece 101 and shelf 105). The member 155 has a flat-sided ear 156 fixed or moulded thereto, the flat side 158 of ear 156 abutting the T-shaped plate of unit 160 when the member 155 is push-fitted downwardly through slot 159. In such a position a pilot hole can be readily drilled through aperture 157 at a predetermined distance forward from the back edge of carcase pieces 101 prior to the drilling of a full bore, countersinking it and then screwing in the upper screws adjacent the rear of the carcase.

The assembled carcase and shelf is then lifted off the unitary items 124 and set aside (there may alternatively be provision to suspend it temporarily above the rails 110). The braking blocks 124 are then repositioned on the abutment blocks 111–113 but now directed rearwardly as shown in FIG. 8. The assembled carcase complete with shelf is then replaced and can now rest on the back face margins of the doors 102, 104 since the limbs 128, 130 of braking blocks 124 are no longer in the way (see FIG. 9). Due to the dimensional symmetry of surfaces 125 and 127 with respect to the 'sliding axis' of limb-and-slot combination 120 and 122, the supplementary surface 127 of each 'reverse directed' unitary item 124 is now vertically in the same plane as that previously containing the main abutment surface 125 (i.e.

with the carcase pieces 101, 103 overlapping door edges 108, 107 or 108, 109 by said predetermined distances). Accordingly, and due to the arms 145 of members 142, the replaced carcase and shelf assembly occupies precisely the same location as during assembly except that it is now at a lower level resting on the backs of the doors. In this 'new' position, it is relatively simple at least to mark accurately the positions to be adopted by the hinge parts and, in most cases, it will be a simple task to fix such hinges immediately. For example after marking the hinge part positions, the carecase can be again removed (or suspended in a raised position) to facilitate drilling of the hinge fixing holes whereafter the carecase is replaced and the hinge parts screwed on or into the side carcase pieces and/or the doors. It will be noted from FIG. 1 that in a preferred arrangement the hinge parts 161 to be mounted in recesses in the doors are provided at the outset and it is only their co-operating hinge parts 163 that are to be mounted on the carcase pieces 101 that are positionally marked and actually affixed following carcase assembly.

Finally, a rectangular rigid sheet (e.g. of hardboard) to constitute the back is nailed and/or screwed to the uppermost rear edges of the assembled carcase and shelf (to the front edges of which the doors are hingedly attached), the clamping arrangement of the jig apparatus is loosened and the finished cupboard is lifted off the loosened jig apparatus such that the said jig apparatus 100 can be re-used either for a similarly dimensioned or a differently dimensioned cupboard.

In a modified arrangement the sliding co-operation between each locating block 124 and the associated abutment block 111–113 is such that the vertical limb (equivalent to guide 120 of FIG. 6) projects outwardly of the main limb 126 and, in effect, forms a substitute for the primary abutment surface 125 in the "forwardly directed" attitude of locating block 124 and equally a substitute for the supplementary abutment surface 127 in the "rearwardly directed" attitude of the locating block 124.

One form of this modified arrangement is incorporated in a further embodiment of this invention part of which is illustrated in FIG. 10. The vertical guide projecting upwards from surface 118 to each abutment block 111–113 is, in this embodiment of FIG. 10 a circular section rod 170 (replacing rectangular guide 120 of FIG. 2). The locating block 124 of FIG. 2 is replaced by locating clamp 174 comprising a flat plate-like portion 178 provided with a lateral cut-out or slot 172 into which the rod 170 fits. From the forward free end of portion 178 remote from slot 172 and extension portion 175 rises upwardly and rearwardly to form a resilient 'leaf' the upper most end 171 of which can engage a carcase piece and urge it resiliently into abutment with rod 170. Such a clamp 174 can be located very readily on limbs 170. The broken lines 173 in FIG. 10 represent a cut-out portion forming a modification of the clamp to enable a shelf 105 to be inserted and rest on the upper horizontal surface 179 of portion 178 (see FIG. 11). It will be noted that the clamp 174 may be disengaged from the guide 170 by lateral movement so that it may be removed without the carcase having to be raised. In the case where the clamp is provided with a cut-out to support a shelf then the extrusion 175 may be formed from separate parts so that the clamp may be moved laterally without the carcase having to be raised.

In the embodiment illustrated in FIG. 11, corner abutment blocks 180 at each corner replace the corresponding blocks 111 and 113 of the embodiment of FIG. 1. The abutment block 180 is slidably mounted on and supports the rail 110 (FIG. 12). A guide rod 170 to support a clamp 174 extends upwardly from each limb of the generally L-shaped plan outline of the block 180. Vertical faces 183 of each limb of the "L" are provided to abut against the door edges 108 and either 107 or 109. A cam mechanism 185 is mounted on a lower horizontal step 182 of block 180. The cam mechanism 185 comprises a circular turret 186 rotatable about its axis by a lever-mounted handle 187, 188 the turret having a cable securing device 181 (e.g. comprising parts such as 134–136) and a cable deflecting device 189 int he form of a projection. At least one of the two devices 181 and 189 is located eccentrically of the turret axis, the cable 140 being secured in device 181 and passing alongside or adjacent to device 189. The arrangement is such that as the turret 186 and its attached lever 187 are manually rotated by the handle 188, the device 189 deflects the cable 140 whihc is thereby tensioned (the other end of the cable is either fixed or subjected to similar deflection by a like cam mechanism 185). The deflected cable 140 can be retained in its deflected or tensioned condition by relatively overlapping it and the lever-mounted handle 187, 188 in the manner shown in FIG. 13, or by frictional engagement of the cam with its base.

A variation of the above-described cable securing device 181 is shown in FIG. 12 where, instead of a threaded screw 135 engaging the portion of cable 140 extending through the cross hole 136 in the spigot 134 upstanding from turret 186, the cable 140 is made to follow a sinuous path between three upstanding projections.

A further variation of the above-described cable deflecting device 189 is illustrated schematically in FIGS. 14*a* and 14*b* where the cable 140 passes in between two cheeks 191, 193 of generally D-section upstanding from the turret 186. The two cheeks 191, 193 are closely spaced and define a slot for the cable that is sufficiently narrow as to grip it tightly upon rotation of the turret 186 in the appropriate direction, i.e. from the position of FIGS. 14*a* to the position of FIG. 14*b* the longer D-shaped cheek 193 deflects the cable 140 to tension it in like manner to that described above with reference to FIGS. 11–13. It will be noted that by using such an arrangement of eccentrically-mounted D-shaped cheeks 191, 193 it may be desirable to render redundant a separate cable securing device 181.

In still another variation, the mode of securing the cable ends comprises an arrangement of parts such as 134–136 (or their mechanical equivalents) at each end of the cable 140, the cable deflecting device 189 being an L-shaped lever 195 pivoted at 196 adjacent the elbow or arms of the 'L', such that when pivoted from the position shown in FIG. 15A to that shown in FIG. 15*b*, the shorter arm of the 'L' deflects the cable 140 and thereby tensions it. Retention of this tensioned condition can be achieved by an 'over-centring' or toggle action of the lever 195.

It will be noted that the cheek 191 of FIGS. 14*a* and 14*b* can alternatively be resiliently urged towards cheek 193 so that as the cable becomes tensioned it is firmly gripped. This is shown in FIG. 14*c*, and is a variation of a cleat-like device, cheek 191 being pivoted and urged resiliently towards the cable.

FIG. 16 illustrates part of a modification to the abutment blocks items 111–113 of FIGS. 1–9. In this modification the abutment surfaces to engage the door edges 108 are the heads of two grub-screws 197 projecting from each surface 147. Rotation of these grub-screws 197 varies the setting of the predetermined distance between door edge 108 and the carcase piece abutment surface 125 (or its equivalent provided by rod 170). The provision of two grub-screws 197, at least on the central abutment blocks 112, enables a pair of doors to be simultaneously engaged and aligned, a separating pin between the doors (to maintain their mutual spacing) being insertable into a hole 198 in surface 147 in between grub-screws 197. Clearly each of the surfaces 147 of unitary items 111 and 113, and of the surfaces 183 of blocks 180 requires only one such grub-screw 197 and does not require the hole 198 (see FIG. 2 and FIG. 12).

Instead of modifying the predetermined distance of carcase/door overlap by appropriate setting of grub-screws 197, it may be desirable to arrange for the upstanding guide limb 120 to be movable, e.g. by providing it with a slotted foot 199 that is screw-securable to surface 118 in adjustable positions (see FIG. 16).

In another modification of the embodiment of FIGS. 1–9, each L-shaped member 142 may be resilient or resiliently mounted to the root of limb 132 such as to be urged inwardly of the carcase outline. The upper end of each arm 145 may be cranked outwardly of the carcase outline such that as the carcase is lifted upwards away from the doors a position is reached where the arms 145 snap resiliently inwardly and their cranked portions underlie the carcase front edges thereby to support the carcase in raised condition above the doors. Such an arrangement avoids the need to remove totally a potentially large and/or heavy carcase when it is necessary to mark out, and/or drill and/or screw affix the hinge parts 161 and/or 163, or when the abutment blocks 112 are to be moved to a different position for the assembly of more shelves than there are block 112 provided to hold them. Other methods by which the carcase can be held raised above the backs of the door will be readily apparent.

Further modifications of the invention within the scope of the appended claims will be clear to persons skilled in the art. Jig apparatus such as that described above may for example be used solely for the assembly and/or construction of open-front articles of furniture e.g. doorless bookcases and the like, the back being instead used as a template. The rails 110 may have a scale marked upon them. There need be no overlap of doors by the carcase although scope may be made for it. There may be provision for a hinge hole-cutter to be guided by the unitary items. Also, when held in the jig, the door edges 108 may act as a stop for a device which presses a carcase piece 101 against a flat guide 120 as illustrated in FIG. 17. Furthermore limb 132 (FIG.2) may be a separable from the remainder of when attachment blocks 111 and 113, and/or may be positionally adjustable to vary the degree of overlap between the carcass and the doors.

FIG. 18 illustrates parts of jig apparatus 200 incorporating modifications of the above-described jig apparatus 100. The two laterally opposite rails 210 are now of rectangular cross-section and have recessed dimples 208 at regularly-spaced intervals along their outer faces. The abutment blocks 211–213 are slidably mounted on the rails 210 and may be secured in positions by grub-screws 209 selectively alignable (if desired) with respective dimples 208. Each of the abutment blocks 211–213 has a pair of guide rods 220 extending vertically upwardly from its horizontal upper surface 218, these two rods 220 replacing the guide 120 of the jig apparatus 100. The locating blocks 224 are slidably mountable on rods 220 via a boreholes 222, the common vertical plane containing the axes of bore-holes 22 being equi-distant and parallel to vertical surfaces 225 and 227 that constitutes the primary and secondary carcase side-piece abutment end locating surfaces. The separate member 155 of jig apparatus 100 is replaced in this modified arrangement by an integral extension plate 255 upstanding vertically from the upper horizontal surface of locating block 224. The inner surface of extension plate 255 is contiguous with primary surface 225. A drill guiding aperture 257 is provided through extension plate 255, this aperture 257 consisting of a circular hole having four equi-angularly spaced radial slots directed outwardly therefrom. These radial slots serve as "sight marks" for aligning the centre of the circular hole whereby the drill bit for drilling the pilot hole can be readily centered. Alternatively the radial slots may serve as mounting means for an insert piece fitting within the extension plate's circular hole, this insert piece itself having a smaller diameter hole that serves to guide the pilot hole drill bit.

The combination of separate unit 160 and members 155 of FIG. 7 is, in this modified jig apparatus 200, replaced by a unit 260 that conforms dimensionally to the locating block 224 in all respects save that it has a screw-threaded clamping device 256 for clamping together a carcase side piece and either a carcase top or bottom piece or a shelf. Optionally, and as shown in FIG. 18, the bore-holes 222 of locating block 224 are not provided it unit 260.

The arrangements for clamping together the jig apparatus 200 about the doors 102, 104 are also somewhat modified from those described-above for the jig apparatus 100. With jig apparatus 200, the corner abutment blocks 211 and 213 are each provided with a cylindrical stub 234 extending outwardly from adjacent the root of that block's limb 132, the stub having a peripheral groove 236 adjacent its free end. Two lengths of cord 240 are provided having one end secured, e.g. as by a knot, to an elongate flat cleat member 285 having a generally V-shaped cut-out in one end edge. The cord 240 is wound around the peripheral groove 236 of one stub 234, through a hole in a door spacer 106, around the peripheral groove 236 of the opposite stub 234 and back to enter the V-shaped cut-out of the cleat member 285, the cord being manually tensioned to draw together the opposite unitary items 211,213 before being inserted into the V-shaped cut-out that frictionally grips tightly about the cord entered therein.

Another modification of such jig apparatus is illustrated in FIGS. 19, 20*a* and 20*b*. As illustrated, the jig apparatus 300 comprises rails 310 of circular cross-section the abutment blocks 311, 313 slidable thereon being of generally "h-shaped" plan outline and the intermediate shelf-supporting block (not shown) being of generally U-shaped plan outline. The blocks 311–313 all have circular apertures through their limbs for close-fitting engagement of the rails 310, these circular-apertures being connected to the outer faces of the limbs by radially-directed slots 310 parallel to the lower and upper (in use horizontal) surfaces 314 and 318 of the abutment blocks 311–313. Two circular rods 370*a*, 370*b* extend vertically upwards from the upper surface 318 of each of the four corner abutment blocks 311, 313. Rod 370*a* extends closely adjacent the door edge abutment surface 147 whereas rod 370*b* extends closely adjacent the door edge abutment surface 133. Each of the four locating blocks 324 that are slidably mounted on pairs of rods 370*a*, 370*b* comprises a plate 329 to support the front edges of the carcase pieces, a circular sleeve 375 to fit slidably on rod 370*a*, a hole 322 in plate 329 through which rod 370*b* should pass, and an upstanding rod 330 having at its upper end a pair of cresent-shaped resilient ears 331, 350.

As apparent from FIG. 20*a*, the difference in the distances from the axis of rod 370*a* to surface 147 in the direction normal to surface 147) and to the outer surface of sleeve 375 determines the degree of overlap of the door by a carcase slide piece 101. Similarly the difference between the radius of rod 370*b* and the distance from that rod's axis to surface 133 (in the direction normal to surface 133) determines the degree of overlap of the door by a carcase top or bottom piece 103. FIG. 20*a* demonstrates how the resilient ears 331, 350 serve to urge the carcase pieces 101, 103 against respectively sleeve 375 and rod 370*b* irrespective (within certain limits) of the thickness of the carcase pieces 101, 103 (shown with a lesser thickness by broken lines in FIG. 20*a*).

When the carcase pieces are secured together and prior to their hinge connection to the doors 102 and 104, the carcase is lifted off from the jig apparatus and the unitary items 324 are all raised until plates 329 clear rods 370*b* whereupon the unitary items 311–313 are all rotated anti-clockwise through approximately 90° and then dropped so as to permit re-positioning of the carcase directly onto the back faces of the doors or, if the doors are too thin, directly onto the surfaces 318 of abutment blocks 311–313. When thus re-positioned (see FIG. 20*b*) the carcase is again located with its predetermined overlap of the door edges since it is again abutted by rod 370*b* and be sleeve 375 (albeit by a surface portion thereof that is angularly spaced from the original abutment surface portion).

In a variation, the locating blocks 324 may each merely have a hole in plate 329 to receive rod 370*a* rather than an integral sleeve 375, a plurality of separate sleeves of different outer diameter being provided from which any one can be selected and slid over the rod 370*a* projecting through plate 320 thereby selectively to predetermine the degree of overlap between a carcase side piece 101 and a door edge 108. Similarly a plurality of separate sleeves of corresponding differing outer diameter may be provided from which any one can be selected and slid over the rod 370*b* thereby selectively to predetermine the degree of overlap between the carcase top or bottom piece 103 and the top or bottom edge 107 or 109 of the doors 102, 104.

Optionally the locating block 324, or the plate 329 and its selected sleeve(s), may be held captive on the abutment block 311, 313 by means of an enlarge head 376 (e.g. a screwed-on cap member) provided at the upper end of rod 370*a*. In such a case the vertical spacing between the top of rod 370*a* is not less than the height of plate 329 and sleeve 375 so that the latter can be raised and rotated from the position of FIG. 20*a* to that of FIG. 20*b*.

FIG. 10 illustrates still another clamping arrangement for the opposite blocks 311 and 313. Two lengths of cord 340 are provided one for each pair of corner abutment blocks 311 and 313. One end of cord 340 is secured to block 313 as by being threaded through an ear 336 and end knotted, the cord passing through a hole in a door spacer 106, around a retaining groove or bore in a lateral projection 334 integral with the laterally opposite block 311 and into a cleat-like V-shaped cord-retaining space defined by the side of limb 332 and the acute-angled surface of a lateral projection from limb 332, e.g. surface 333 of lateral projection 334.

Still further embodiments of this invention and providing jig apparatus for use in the construction of both open-fronted and close-fronted (e.g. as by doors) articles of carcase-type furniture, are disclosed below with reference to FIGS. 21 to 30.

The schematic plan view of FIG. 21 illustrates the arrangement of another preferred form of jig apparatus embodying this invention for the construction of a cupboard having two pairs of doors 2, 4 and a single shelf 3 extending across the cupboard in line with the gap between the "upper" door pair 2 and "lower" door pair 4. The jig apparatus 10 of FIG. 21 comprises two elongate guide members 11 having a generally L-shaped cross-section as illustrated in FIG. 22. The guide members 11 are placed alongside the door pairs with the horizontal limbs 12 (that have flat bottom surfaces 13) directed outwards and the vertically upstanding limbs 14 directed adjacent the side edges of the doors 2, 4. Each upstanding limb 14 has a dovetail-section groove 15 therein to provide a rail for carcase piece supporting members 16, each such supporting member 16 having a mating dovetail-section rearward projection 17 slidably insertable into the groove 15.

Essentially each of the supporting members 16 comprises a flat planar flange 18 (FIG. 24) to overlie the doors 2, 4 and provide a horizontal carcase-piece support surface 19 extending inwardly of the intended carcase at right-angles to limb 14 (or, see FIG. 22, to at least vertical abutment surface 20 of limb 14). Preferably the flanges 18 of members 16 are each integral with an upstanding limb 21 to provide a vertical abutment surface 22 for abutting against the outer face of a carcase side piece whilst the latter is supported by its front edge on flanges 18 that are spaced apart longitudinally of guide member 11.

As representationally illustrated in FIG. 23, each flange 18 provides a guide rail for one of three members 23, 24, 25 to slide therealong. Each of members 23–25 comprises a generally U-shaped part 30, the two parallel limbs 26 of which providing flat, mutually parallel, abutment faces 27 for abutting against the opposite major faces of a carcase top or bottom piece or of a shelf. The aligned outwardly facing edges 28 (FIG. 24) of limbs 26 provide abutment surfaces for abutting against the inner face of a carcase side-piece. The inner faces 27 of limbs 26 are undercut adjacent the horizontal bight wall 29 of the U-shaped part 30 to provide a slot 31 into which flange 18 extends. This slot-and-flange arrangement provides for sliding co-operation between a member 23, 24 or 25 and any support member 16. Member 25 consists of said generally U-shaped part 30. However, each of members 23, 24 comprises a depending rib or web 33, 34 directed in the opposite direction to limbs 26 but parallel thereto and at right angles to bight wall 29. Web 33 is coplanar with one limb 26 of member 23 (see FIG. 24*a*), and web 34 is disposed midway between the two limbs 26 of member 24 (see FIG. 24). Alternatively web 33 may be parallel to and offset by a predetermined small distance from a limb 26.

Assembly of the carcase-type cupboard will be apparent from FIG. 21 and, especially, from FIG. 23 (which shows an optional support 25 that is omitted from FIG. 21). Initially, three support members 16 are slidably mounted on each guide member or rail 11, the slidable mounting being by means of the co-operating, dovetail-section groove 15 and projection 17. A member 23 is slidably mounted on each of the four outer support members 16 and a member 24 is slidably mounted on each of the two intermediate support members 16, the slidable mounting in each case being by means of the co-operating flange 18 and slot 31. The disposition of the members 23 is such that the two members 23 adjacent the top of the intended carcase are in the opposite sense to the two members 23 at the bottom of the intended carcase. Advantageously in each combination of two memebers 16 and 23 or 16 and 24, the two respective members may be movable towards one another, e.g. by a screw mechanism (not shown) or resiliently as by a tension coil spring (not shown) connected between them. In this event the arrangement is such that edges 28 are movable outwardly of the jig away from the free end of flange 18 (i.e. towards surface 22 of limb 21, where the latter is provided).

The two rails 11 are urged towards one another to sandwich the doors 2, 4 between them, the web 34 extending from each rail in between two doors 2, 4. An X-shaped member 35 (FIG. 25) is disposed at the common corner of all four doors 2, 4 and in between them. The member 35 has four webs 36 in cruciform array to abut against the door edges, at least two aligned portions 36 being surmounted by an integral flange 37 to provide a T-shaped cross-section. Two further members 38 (FIG. 26) having a similar T-shaped cross-section formed by a web 36 depending from an integral flange 37, are disposed remote from member 35 with their webs 36 inserted in between respectively the "upper" doors 2 and the "lower" doors 4.

The two outer support members 16 (carrying members 23) on each rail 11 are slid along that rail towards one another to sandwich the two adjacent doors 2, 4 between the two depending webs 33 of members 23 mounted thereon. It will be seen from FIG. 23 that the two members 23 are slidably mounted on the support members 16 in opposite senses so as to ensure that their bight walls 29 overlie the doors 2, 4 when the latter are sandwiched lengthwise by urging together the longitudinally spaced members 23 and sideways by urging together the rails 11. It will be appreciated that such two-directional sandwiching of the doors 2, 4 ensures a predetermined spacing between them defined by the width of webs 34 and of the webs 36 of members 35 and 38.

With the doors positioned and aligned, e.g. by the use of additional door-pair alignment members 39 (see FIGS. **21, 27, 28*b*), the carcase pieces may be cut or sawn to length and located in position in the jig apparatus 10. The locating procedure for the carcase pieces, i.e. the top, bottom and two sides, may be more clearly understood by reference also to FIG. 27 which is illustrative of modified jig apparatus 40. Jig apparatus 40 of FIG. 27 is identical to jig apparatus 10 of FIGS. 21–26 except that the guide members or rails 11 are replaced by guide members or rails 41 of different cross-section but like dovetail-section grooves 15**.

A carcase side piece 5 is placed alongside each rail 11 or 41 and is supported by the three support members 16, its long edge resting on the three surfaces 19 and its outer major face abutting against the surfaces 22 of the three limbs 21 (where provided) or directly against the inside upper face 42 of the rail's vertical limb 14 or 44. The three outwardly urged members 23, 24, 23 engage the inner major face of the carcase side-piece by means of their outwardly facing edges 28 so as to trap and positionally locate the carcase side-piece. The top and bottom carcase pieces are then positioned with their shorter end edges disposed between the carcase side pieces and their major faces located between the limbs 26 of members 23. Each of the top and bottom carcase pieces (only the top carcase piece 6 is shown in FIG. 27) is supported by its long edge on the supporting surfaces 19 of opposite members 16 and has its outer and inner major faces in abutment with the inner faces 27 of limbs 26 such that the latter hold the carcase piece trapped in its desired position. Similarly the shelf 3 is located between, and held positionally trapped by, the limbs 26 of the two members 24 disposed adjacent the ends of shelf 3, the shelf being supported by its long front edge on the supporting surfaces 19 of opposite members 16 and being positioned between the two carcase side pieces 5.

With the four doors, the four carcase-pieces and the shelf all aligned in their desired positions and held therein by the jig apparatus, appropriate connecting fittings (e.g. hinges, corner brackets, shelf supports) may be fastened to the elements or fastening holes therefor drilled into the elements. For example, for drilling holes from the outer face of a carcase side piece into a carcase top piece, bottom piece of a shelf, a supplementary marking mechanism or template may be employed, e.g. such as that described above with reference to FIGS. 6 and 7 or to FIG. 18.

After hole marking and/or drilling and/or at least partial interconnection of the various carcase elements, the jig apparatus 10 or 40 may be at least partially disassembled and the remaining carcase-pieces doors and shelf or shelves fully interconnected in their correct inter-relationship as predetermined by the jig apparatus. As previously mentioned, the gap between the doors 2, 4 is predetermined by the width pre-set or pre-selected for the webs 34 and 36 of the members 24 and 35. The degree of margin overlap by which the doors 2, 4 overlie the front edge of the finished carcase is determined by the distance between surfaces 20 and 22 (if member 16 is provided with limb 21)—see FIG. **28*a*—or between surfaces 20 and 42 (if member 16 is not provided with limb 21)—see FIG. 28*b*. If this distance is zero, then the doors will fully overlap the front edge of the carcase. If this distance is equal to (or slightly more than) the thickness of the carcase-pieces, then the doors will be able to lie inset within the carcase such that the carcase sides lie alongside the doors. In other words, the distance between surfaces 20 and either 22 or 42** is equal to the width of the carcase front edge that remains exposed and uncovered by the doors.

As shown in FIGS. 27 and **28*c*, the surface 20 may extend vertically up to the underside of flange 18 instead of stopping short as in FIGS. 22 and 28*a*. In another alternative arrangement the jig apparatus comprises guide members 51 (FIG. 28*d*) instead of guide members 11 or 41, and each support member 16 is provided integrally with a downwardly extending limb 52 providing a vertical surface 50 for abutting against the edge of a door 2, 4 or other carcase front piece. In such an arrangement, the degree of margin overlap by which doors 2, 4 overlie the front edge of the finished carcase is determined by the distance between surfaces 50 and 22 (if member 16 is provided with limb 21) or between surfaces 50 and 42 (if member 16 is not provided with limb 21**).

Ideally, the vertical length of limbs 21 and 52 (where provided) is such that, in use, they stop short of and do not project beyond respectively the top and bottom of the guide member 11, 41 or 51. This not only facilitates use of the marking template device of FIGS. 6 and 7 or of FIG. 18, but also enables the members 16 to be slidably mounted for storage in grooves 53, 55 provided in the surfaces of guide member 51 opposite surfaces 42 and 13 respectively. The two rails or guide members 51 may then be together disposed as shown in FIG. 29 in the form of an elongate box with all the members 16, 23–25, 35, 38 and 39 stored within the box.

It will be appreciated that if, in addition to flanges 18, limbs 21 and/or limbs 52 are required for creating appropriate degrees of door overlap, they can be provided separately from flanges 18 with their own rearward projections of dovetail cross-section for sliding insertion along a rail 11, 41 or 51 and location at any door-adjacent position. Such an arrangement enables, at minimal expense, several versions of the limbs 21 and/or 52 to be provided, having different predetermined thicknesses for optional selection of any predetermined degree of door overlap.

Similarly, to minimise expense, the members 23–25 can each comprise a basic U-shaped member 45 (FIG. 30) that is equivalent functionally to member 25 (or part 30) and differs therefrom principally in that the underside of its bight wall 29 is provided with a groove 46 of dovetail cross-section. To provide the functional equivalent of member 23, member 45 is conjoined with a generally L-shaped member 48 having a web 43 depending at right angles from an integral flange 47 of mating dovetail cross-section, the latter being slidably inserted into groove 46 such that web 43 is in use equivalent to web 33 of member 23. To provide the functional equivalent of member 24, member 45 is instead conjoined with a generally T-shaped member such as member 38 (FIG. 26), the flange 37 of the latter being of mating dovetail cross-section for sliding insertion into groove 46 such that web 36 is in use equivalent to web 34 of member 24. As with the limbs 21 and/or 52, the members 38 and 48 can be produced, at minimal expense, in several versions each having a different predetermined thicknesses for the webs 36, 43 so as to provide for optional selection of any predetermined degree of door overlap (web 43) or gap between the doors (web 36). Various corresponding versions for member 35 may also be readily provided.

Alternatively one basic thickness may be provided for the webs 33, 34, 36 and 43, and different U-shaped clips (not shown) fastened thereon, the clips being selected from various versions of differing limb thickness.

It will also be appreciated that the space between surfaces 28 and either 22 or 42 is adjustable due to the slidable mounting of member 23–25 or 45 on flange 18. This allows for use of different thicknesses of board for the carcase-pieces. Where, in a modified arrangement, members 16 and either 23–25 or 45 are integral with one another, then the space between surfaces 28 and 22 or 42 may be adjustable by mounting U-shaped clips of an appropriately selected predetermined thickness over the edges 28 of limbs 26 or on the limbs 21 or on limbs 14 or 41 of the guide members. Similarly, U-shaped clips of appropriate predetermined thickness may be mounted on one or both of the limbs 26 of members 23–25 or 45 so as to adjust the space between surfaces 27. Alternatively, to adjust the space between surfaces 27, one of the limbs 26 may be movable, e.g. by screw means, towards and away from the other, or may have a resilient member mounted thereon. All these space adjustments are to enable different thicknesses of carcase-piece to be used and accommodated properly in vertical upstanding position supported by their front edges on the support surfaces 19 of flanges 18.

Where the jig apparatus 10 or 40 is to be used in the construction of an open-fronted, carcase-type article of furniture, e.g. a bookcase, then members 24, 35 and 36 become redundant and member 23 may be replaced by member 25 or member 45 (member 48 being omitted). Other embodiments of jig apparatus according to the present invention and for use in the construction of bookcases and the like, are described below.

Further variants which will be clear to those skilled in the art are described below. The guide members (11, 41, 51) may have a different groove cross-section for mating co-operation with a different cross-section of the rearward projection 17 of member 16. Alternatively, the members 16 may be arranged to slide on a generally horizontal surface provided by the elongate guide member in the manner of a rail.

Furthermore, the guide members or rails (11,41,51) may be provided with means for locking co-operation with members 16 in different predetermined positions, e.g. by a detent mechanism comprising a spring-urged ball (not shown) in member 16 engageable selectively with one of several depressions 56 formed in the rail at equi-spaced longitudinal intervals. Furthermore, the guide members or rails may be fastenable to a table or a base sheet, e.g. in selected ones of a predetermined array of possible locations (for example by depending pegs into a base sheet of apertured peg-board), or to the two arms of a clamp or vice (e.g. that sold under the Trade Mark "WORKMATE") whereby the doors 2, 4 may be more readily held firmly in position during carcase construction. An intermediate base or support for members 39 is shown in FIG. 27 as an elongate strip 59 that serves also as a support for the doors 2, 4 in conjunction with the base flange 49 of guide member 41. The guide members or rails (11, 41, 51) may be of any suitable material but preferably are extrusions or "profiles" of aluminium or aluminium alloy. The members 16, 23–25, 35, 45 and 48 are similarly of any suitable material, preferably of aluminium or aluminium alloy and advantageously all (apart from member 35) in the form of sections cut off from extrusions or profiles.

The embodiment of FIG. 31 provides jig apparatus including nine similar members 400 for use in the construction of a cupboard having two pairs of double doors 402, 404 and a single shelf (not shown) extending across the cupboard in line with the gap 403 between the "upper" pair of double doors 402 and the "lower" pair of double doors 404. Each member 400 is of cruciform plan outline and in vertical section through each of its four limbs comprises a U-shaped channel section 405 from the base of which depends a web 406 (see FIG. 32). The bases of the four channel sections 405 are all provided adjacent their free ends with holes 407 through which one or more bolts or screws 408 can be upwardly threaded.

In use the four doors 402, 404 are placed front faces down on a horizontal surface and the nine cruciform members 400 placed thereon as shown in FIG. 31. The bases of all the members 405 are adjusted to be horizontal by appropriate screwing of the threaded members 408 in the holes 407 of the eight outer members' outwardly projecting limbs (see FIG. 32). The webs 406 that are sandwiched between adjacent door edges serve to define the desired spacing between such door edges in the final cupboard. This spacing can optionally be modified by for example adding lateral projections, e.g. removable clip members (not shown) to the webs 406 or by providing the webs 406 of differing thickness. The members 400 may optionally be secured in position by securing them to the backs of the doors, e.g. by nailing through the holes 407 above the door backs. The pieces of board 401 to form the carcase sides, top and bottom and also the shelf are cut to size and located in the channels 405 with their intended front edges directed downwards and supported horizontally by the bases of the channels 405 and with their major faces all located in vertical planes by the upstanding walls 409 of the channels 405.

Optionally the webs 406 may be continuous (as shown) or discontinuous, e.g. formed by pressing out tabs from the channel base at longitudinally (and possible laterally) spaced locations to provide a web of appropriate thickness (possibly independent of the base thickness). Similarly the web may be offset asymmetrically from the channel walls 409. The walls 409 of each channel 405 may have a variable spacing, e.g. by the use of wedges or of screw-threaded adjustment means.

With the shelf carcase pieces 401 located and held in position by the members 400, they are secured to one another to form the carcase and the holes for the hinges and their attachment means are marked and/or drilled. The carcase is raised to permit withdrawal of the members 400 (for subsequent re-use) and is then lowered to permit final attachment of the doors to the carcase in their predetermined positions. The completed cupboard may then be raised by pivoting it upwards about the horizontally lowermost front edge of the carcase bottom piece.

In a modification to the embodiment of FIGS. 31 and 32, the nine members 400 may comprise only one member of cruciform plan outline for disposition where four door corners are mutually adjacent, plus four members of generally T-shaped plan outline for disposition where just two door corners are mutually adjacent, plus four members of generally L-shaped plan outline for disposition at the remaining door corners, i.e. the outer corners of the intended final carcase. Also, to provide a vertical space during assembly or construction between the carcase and the doors, the webs 406 of the members may be of a height greater than the thickness of the doors, these webs 406 optionally being separable from the channel 405 and/or integral with horizontal platforms from which they extend vertically upwardly, the doors being positionable upon the platforms with their edges abutting the webs.

From the foregoing, it will be seen that the jig necessarily incorporates abutment means to contact the edges of the panel(s) usually the door(s) and locating means to hold the carcase walls while being secured to one another. Any convenient means can be used to maintain the relative position of the various components of the jig and in addition to those already described one can envisage an embodiment wherein blocks equivalent to the abutment and locating blocks can be mounted in any desired position on a matrix board or peg board. The blocks in such a case can be held in place by a screw or the like passing through a slot the length of which is equal to the distance between holes on the board.

I claim:

1. A method of constructing a carcase-type article of furniture, which comprises placing down horizontally a panel which is to form a part of the finished article, assembling a jig around the panel using the panel as a template, the jig including abutment surfaces to contact the edges of the panel and locating means in predetermined positions relative to the abutment surfaces to define a position for each of a plurality of carcase walls and to locate the walls in position for being secured to one another, cutting each of the carcase walls to a respective desired size, placing the carcase walls edge down within the locating means defined by the jig, and securing the walls to one another, thereby forming a carcase-type article; the walls of which are correctly aligned with the edges of the panel.

2. A method as claimed in claim 1, wherein the panel is a door and the method additionally comprises the step of securing a plurality of door hinges to the carcase walls while the carcase-type article is located in position by the jig.

3. A method as claimed in claim 2, additionally comprising the step of securing a back panel to the carcase walls while the carcase-type article is located within the jig.

4. A method as claimed in claim 1, wherein the step of placing down a panel comprises placing down double doors horizontally with a predetermined clearance therebetween, the step of assembling the jig comprising assembling the jig around the doors while maintaining the doors in the desired position.

* * * * *